United States Patent [19]

Morrison

[11] Patent Number: 5,056,869

[45] Date of Patent: Oct. 15, 1991

[54] RESTRAINING HARNESS TO HOLD CHILD IN HIGHCHAIR

[75] Inventor: George A. Morrison, 5919 E. 4th St., Tucson, Ariz. 85711

[73] Assignee: George A. Morrison, Tucson, Ariz.

[21] Appl. No.: 546,727

[22] Filed: Jul. 2, 1990

[51] Int. Cl.[5] ..... A47D 15/00

[52] U.S. Cl. ..... 297/485; 297/467; 297/484

[58] Field of Search ..... 297/465, 467, 485, 484

[56] References Cited

U.S. PATENT DOCUMENTS

| | | | |
|---|---|---|---|
| 2,413,395 | 12/1946 | Ware | 273/38 R |
| 2,414,698 | 1/1947 | Picard | 196/96 |
| 2,741,412 | 4/1956 | Hinkle | 297/467 |
| 3,321,247 | 5/1967 | Dillerder | 297/465 |
| 3,604,750 | 9/1971 | Boering | 297/485 |
| 3,713,692 | 1/1973 | McCracken | 297/467 |
| 3,954,280 | 5/1976 | Roberts | 297/467 |
| 4,235,474 | 11/1980 | Rosenberg | 297/485 |
| 4,324,430 | 4/1982 | Dimas | 297/250 |
| 4,340,218 | 9/1985 | Thomas | 297/467 |
| 4,571,000 | 2/1986 | Holder | 297/465 |
| 4,674,800 | 6/1987 | Ensign | 297/465 |
| 4,697,849 | 10/1987 | Smith | 297/485 |
| 4,702,523 | 10/1987 | Schroder et al. | 297/485 |
| 4,834,460 | 5/1989 | Herwig | 297/485 |
| 4,867,464 | 9/1989 | Cook | 297/485 |
| 4,871,210 | 10/1989 | Alexander et al. | 297/485 |
| 4,927,211 | 5/1990 | Bolcerek | 297/467 |

FOREIGN PATENT DOCUMENTS

| | | | |
|---|---|---|---|
| 0209258 | 1/1987 | European Pat. Off. | 297/485 |
| 2105410 | 4/1972 | France | 297/467 |

*Primary Examiner*—Peter R. Brown
*Assistant Examiner*—Cassandra L. Hope

[57] ABSTRACT

A restraining harness to hold a child in a highchair is disclosed consisting of an elongated panel having strategically placed VELCRO hook and loop type fasteners thereupon such that the panel will encompass completely a range of highchair backs ranging in heights from 17 inches to 8 inches, the panel always arranged and attaching to itself such as to firmly engage the highchair back and present the same end emerging at the top of the highchair back. Further, only the loop-type VELCRO hook and loop type fasteners are presented to the backside of a child. A plurality of straps operably attached to the panel pass parallel over the child's shoulders to a holding strap, and then converge to a single strap passing through the child's legs and under-the-seat to rejoin the panel. A chest encircling strap is operably attached to the panel and the shoulder straps. In addition, the device may be folded to its smallest and most compact configuration to reside entirely upon the back of a child separate from the highchair whereupon a holding and walking strap may be attached to one of the rear clasps in order that an adult may hold the strap vertically to help hold the child erect when the child is learning to walk.

15 Claims, 2 Drawing Sheets

RESTRAINING HARNESS TO HOLD CHILD IN HIGHCHAIR

BACKGROUND OF THE INVENTION

1. Field of the Invention

The field of the invention is restraining harnesses adapted to hold children in their highchairs which also provide easy removal of the child from the harness by the adult when desired.

2. Description of the Related Art

The obvious need to restrain children in their highchairs for their own safely has prompted a considerable amount of inventive activity over the last number of years resulting in many various types of restraining harnesses. Restraining the child in the highchair has been accomplished by a number of different ways, some confining the child in a harness and then connecting the harness to the highchair. Others confine the child to the highchairs by building a cage which blocks routes of possible escape.

For example, devices shown in United States Patents to Hinkle (U.S. Pat. No. 2,741,412), Ware (U.S. Pat. No. 2,413,395), and Roberts (U.S. Pat. No. 3,954,280) show devices which secures the body of the child and then is in turn secured to the highchair, or in the case of Roberts to an automobile seat.

Other devices such as those shown in the United States Patent to Picard (U.S. Pat. No. 2,414,698), Dimas (U.S. Pat. No. 4,324,430), Cook (U.S. Pat. No. 4,867,464), and McCracken (U.S. Pat. No. 3,713,692) illustrate devices which primarily attach to a highchair and then with straps emanating from the attachment, surround various parts of the child.

The problem with highchair type restraining harnesses known to the inventor is that the harnesses are each designed and adapted to restrain the child in a specialized type of highchair, or as in the case of the device of Dimas, a chair-like carrier.

Further, over the last number of years, the construction of highchairs appears to have evolved to more or less standard models with a substantial difference between the models as to how high the rear seat structural member is in height, varying from as little as five (5) inches to as high as seventeen (17) inches.

Accordingly, in many cases the prior art restraining harnesses are not suitable for use in presently available highchairs. As a consequence, there appears a great need for a restraining harness for children in highchairs which is universally adaptable to modern highchairs and which are safe and secure and resist efforts of the child to either unbuckle the harness or otherwise slip out of it.

In addition, it would be useful if such a harness were convertible to a child walker, i.e., where children are just starting to learn to walk with the harness being used by an adult to hold the child erect during its early walking time to prevent the child from falling over.

SUMMARY OF THE INVENTION

The embodiment of the invention described consists of a universal harness for restraining a child in a highchair as well as a harness for a child to wear for an adult to hold the child erect when the child is just beginning to walk.

When the invention is utilized as a restraining harness for a child in a highchair the device is adapted to be used on presently available highchairs consisting of a bottom seat, sidearms if desired, and a back. The back of the highchair may have a height (or length) as small as five (5) inches or as great as seventeen (17) inches. The subject harness provides complete safe and comfortable securing of the child to the highchair by firmly encompassing the back of the highchair with a flexible material panel regardless of the height of the back and then surrounding the child with a plurality of strategically placed straps attached to the panel.

In construction, the device consists of an elongated flexible material panel adapted to totally encircle the back of the highchair in a sufficiently tight manner and then from that securing position, issue soft straps to encircle the child. From the end of the panel which emerges at the top of the back of the highchair, two spaced apart parallel straps attached to the panel encompass the shoulders of the child on opposite sides of his neck. These two straps converge after passing parallel over the child's shoulders to between the child's legs to terminate at a clasp, the other side of the clasp continuing with a single strap between the remainder of the child's legs and then over the edge of the highchair seat to run underneath to the rear of the highchair seat and return to the panel. Immediately prior to connection with the panel, it is secured to a second clasp mechanism which in turn is attached to one end of a short strap, the other end of which is attached to the rear side of the panel. Lastly, a horizontal chest encircling strap (or lower abdomen strap depending upon the size of the child) passes through a loop situated on the back side of the panel which encircles the child at about its lower chest (or stomach) area to pass through two (2) loops attached to the two (2) straps encompassing the child's shoulders just prior to their convergence to a single strap. The ends of the chest strap attach to themselves to provide a completed circle.

Means are provided on the panel to secure it around the highchair back such that at all times, the panel is tightly secured to the back. The means which secure the harness panel around the highchair back are strategically placed VELCRO hook and loop type fasteners sewed on both flat sides of the elongated panel. These fasteners permit the panel to be folded and held in a folded condition such as to encompass a small highchair back or a large highchair back.

When the subject invention is being utilized as a harness for holding erect and walking a child, the panel is folded to its most compact configuration by means of these strategically placed VELCRO hook and loop type fasteners, permitting the panel to reside on the child's back while encompassing the child around the shoulders as in the highchair situation with the under-the-seat strap passing between the child's legs to be firmly connected to the clasp on the panel. The chest encompassing strap then passes around the child's chest through the loops on the shoulder straps and the panel and is secured. Lastly, an additional holding and walking strap is attached to a second clasp located on the panel, this strap held by the adult to keep the child erect to prevent falling while the child is learning to walk.

Accordingly, it is an object of the subject invention to provide a means whereby a child may be comfortably restrained in a highchair from falling.

It is another object of the subject invention to provide a harness for restraining a child in a highchair where the harness is adaptable to highchairs with varying different sized back heights.

It is still a further object of the subject invention to provide a combined harness for restraining a child in a highchair and a harness for walking a child just learning to walk.

Other object of the invention will in part be obvious and will in part appear hereinafter. The invention accordingly comprises the apparatus possessing the construction, combination of elements, and arrangement of parts which are exemplified in the following detailed disclosure and the scope of the invention which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
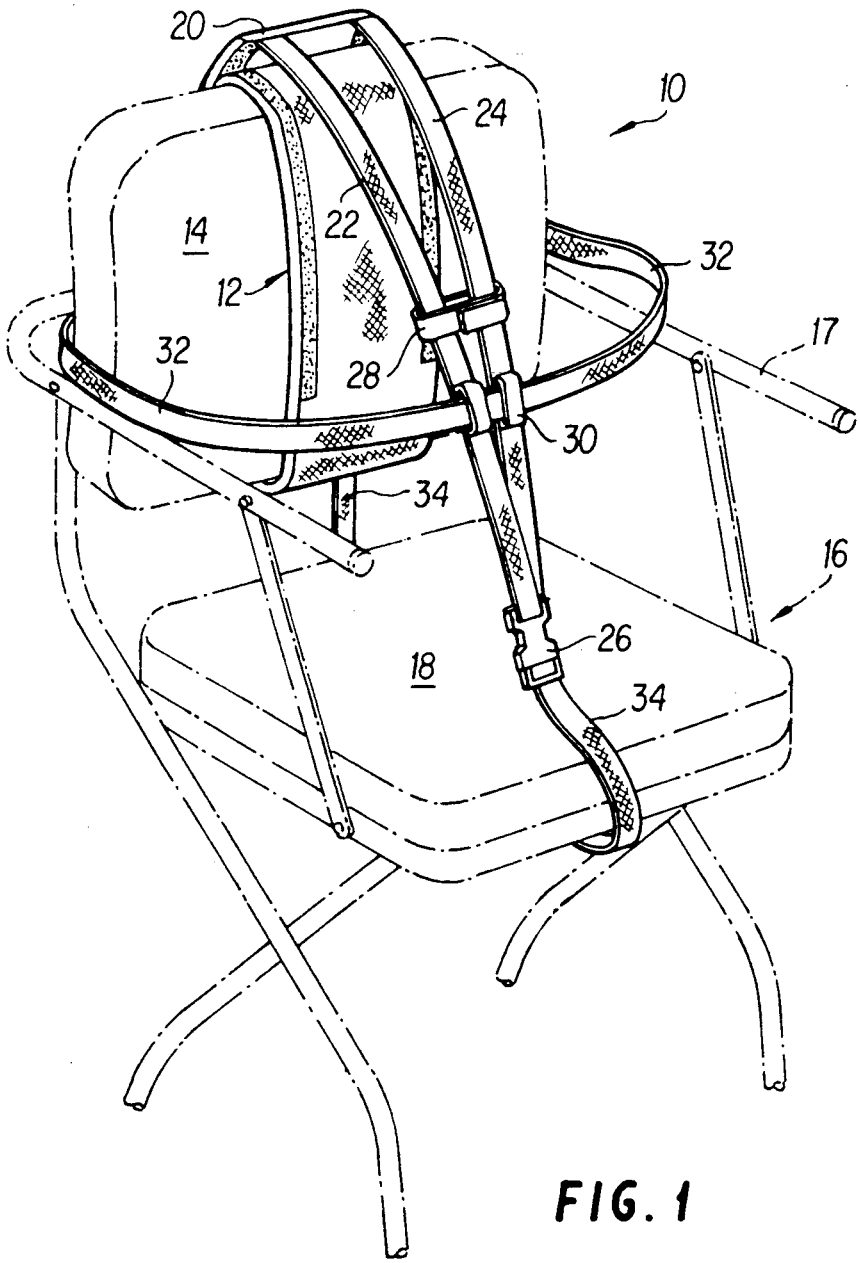
FIG. 1 is a perspective view of the subject invention in place on a highchair.

Referring now to FIG. 1, a perspective view of child restraining harness 10 shown in place on a child's highchair. Making up the restraining harness is firstly panel 12 which completely wraps around back 14 of highchair 16. Panel 12 is secured in position as shown in FIG. 1 for the case of highchairs with relatively high backs such as shown in FIG. 1. In practice, it has been found that these backs may have a vertical height or length of seventeen (17) inches. This does not include the distance from the seat to the back.

Emanating from leading edge 20 of panel 12 are a pair of shoulder straps 22 and 24 which run substantially parallel for a distance (at least to the child's upper chest area) and then converge to connect with the female portion of clasp 26. Situated around shoulder straps 22 and 24 to keep them parallel is holding loop strap 28 which is sewed at one end to strap 24 and encircles strap 22 and returns for attachment to strap 24. VELCRO hook and loop type fastening materials upon the top of strap 22 as well as the top of strap 24, and upon the whole length of holding loop strap 28, serves to hold the shoulder straps 22 and 24 spaced apart and substantially parallel in the run from back panel 12. Holding loop strap 28 is also so placed as to be away from the child's neck. From the point of holding loop strap 28 to clasp 26, the straps converge and attach to clasp 26. Clasp 26 is located where it is situated between the child's legs next to seat 18 to be out of the child's immediate sight to avoid the child playing with it. It is entirely possible that clasp 26 may be placed just under seat 18.

Additionally, attached to the top of shoulder straps 22 and 24 between holding loop strap 28 and clasp 26 is a pair of loops 30 formed from strap material through which is allowed to pass chest strap 32. Chest strap 32 encircles the child at the lower chest or abdomen (depending upon the size of the child) region, passes through a loop on panel 12 behind the highchair and hidden from view in FIG. 1. Chest strap 32 attaches to itself by means of VELCRO hook and loop type fasteners attached at each end of the strap and upon opposite sides.

The strap continues from clasp 26 wherein the male portion of clasp 26 is attached to under-the-seat strap 34 which passes the remaining distance between the child's legs and crosses underneath seat 18 of highchair 16 where it continues up from the rear portion of the seat to join clasp 44 (not shown in FIG. 1) attached to the back portion of panel 12. In addition, strap 34 is so constructed that the length of the strap may be varied in order to assure that the restraining harness is sufficiently tight, but not uncomfortably tight, around the child held in the highchair.

As seen from the orientation of straps shown in FIG. 1, the child, when sitting in highchair 16, will sit on seat 16 with his head between shoulder straps 22 and 24, straps 22 and 24 resting upon the child's shoulders and holding loop strap 28 immediately below the child's neck in the upper chest area. Thereafter, chest strap 32 which runs through loops 30 attached to the top of shoulder straps 22 and 24, encircles the child at the lower chest area. Clasp 26 allows the connection of shoulder straps 22 and 24 to one end of under-the-seat strap 34, the opposite end of which is attached to the female portion of clasp 44 at the back of panel 12. The under-the-seat strap's length is adjusted at its attachment to the male portion of clasp 44 situated at the back of panel 12 such as to firmly secure the child in the highchair. Thus, the child is prevented from excessive side-to-side motion by both shoulder straps 22 and 24 as well as chest strap 32. The child is prevented from standing up by the restraint imposed upon him by shoulder straps 22 and 24 and further, the child is prevented from slipping out of the highchair in a forward direction by means of under-the-seat strap 34 which resides between the child's legs. Arms 17 of the highchair also prevent the child from going sideways.

Figure 2:
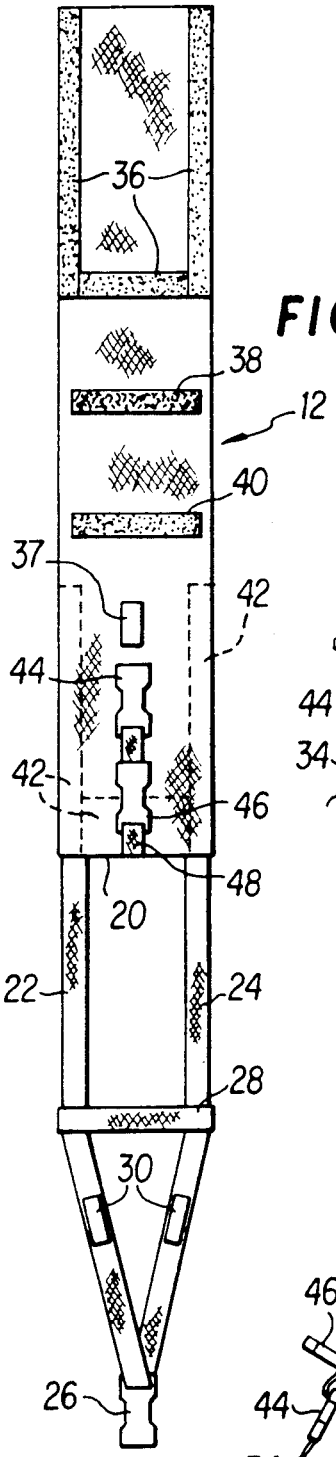
FIG. 2 is a top view of the invention laid out in a straight line.

FIG. 2 is a top view of panel 12 and associated straps laid out in a straight line. As can be seen, panel 12 is quite elongated as it must be sufficiently long to completely encircle a highchair back which may have a height of seventeen (17) inches, therefore requiring that panel 12 double that distance plus a few more inches, in the preferred embodiment, approximately 40 inches. In any event, shown along panel 12 are the various elements by which attachment of straps and itself to itself is made. At the top end as shown in FIG. 2, are a series of VELCRO hook and loop type fasteners 36 which is the loop-type of VELCRO hook and loop type fasteners. These strips of VELCRO hook and loop type fasteners run along opposite sides of panel 12 from the end of the panel to join to a cross or transverse VELCRO hook and loop type fastener. In the preferred embodiment, these strips are slightly over 20 inches in length, about half the length of panel 12. Continuing, first cross VELCRO hook and loop type fastener 38 which is also loop-type VELCRO hook and loop type fastener, is spaced apart from the cross portion of VELCRO hook and loop type fastener 36. Continuing down and spaced from cross VELCRO hook and loop type fastener 38 is second cross VELCRO hook and loop type fastener 40 which is the hook-type portion of VELCRO hook and loop type fasteners.

Then, shown in dotted fashion because it is on the underside of panel 12 shown in FIG. 2 is VELCRO hook and loop type fastener 42 which is of the hook-type. VELCRO hook and loop type fastener 42 are strips of VELCRO hook and loop type material sewed along each of the sides of panel 12 to the end of panel 12 where it is joined by the portion of fastener 42 which crosses the panel 12 at the end. In the preferred embodiment, the length of VELCRO hook and loop type fastener 42 is about half the length of VELCRO hook and loop type fastener 36, or approximately 10 inches ($\frac{1}{4}$ the length of panel 12).

As will be explained later, the hook type VELCRO hook and loop type fastener 42 will be attached to loop-type VELCRO hook and loop type fastener 36 as panel 12 is folded in special ways to encompass smaller highchair backs than back 14 illustrated in FIG. 1. In addition, special folding is required to prepare panel 12 for attachment to the child when using in the child walking situation.

Situated between the oppositely spaced strips of VELCRO hook and loop type fasteners 42, but on the opposite side of panel 12, is loop 37 comprising a short piece of strap material sewed to panel 12. Through this loop passes chest strap 32. Also attached to panel 12 is a pair of clasps 44 and 46, these clasps being of the female portion of the clasp. Clasp 44 shown in FIG. 2 is used to join to the male portion of clasp 44 attached to the end of under-the-seat strap 44 and clasp 46 (female portion shown in FIG. 2) is used with the holding and walking strap by which a parent helps holding a child erect while the child is learning to walk. Both female portions of clasps 44 and 46 are attached to one securing strap 48, strap 48 formed into one big loop which is sewed near the point of where the strap turns on itself to surround a cross or transverse pin on clasp 44, and the cross or transverse pin of clasp 46 then held in the loop formed between clasp 44 and the ends of strap 48 sewed to panel 12.

Continuing, shoulder straps 22 and 24 are attached by sewing to panel 12 at opposite ends of leading edge 20 of panel 12 where they continue for a distance to the point where they are joined by holding loop strap 28, a distance of about $\frac{2}{3}$ the length of VELCRO hook and loop type fastener 36. Holding loop strap 28 is attached at one end to shoulder strap 24. It then extends over to shoulder strap 22 to cross under and then return to strap 24 where it attaches to itself. A small piece of VELCRO hook and loop type fastener is attached to the top of strap 22 which mates with VELCRO hook and loop type fastener attached along the inside of the complete length of strap 28, the top half of the length being hook-type and the bottom half loop-type. By this means, the strap's thickness is more than doubled and it tends to be somewhat rigid. No part of the VELCRO hook and loop type fastener on strap 28 or on strap 22 touches the child's skin. Holding loop strap 28, being fixedly attached to shoulder strap 24 and connecting to strap 22, serves to keep separate and parallel straps 22 and 24 so as not to press against the sides of a child's neck in a tightening or pinching manner.

Continuing, loops 30 made of strap material are sewed to the tops of shoulder straps 22 and 24 to receive chest strap 32 as shown in FIG. 1. Chest strap 32 merely passes through these loops 30 as it encircles the child.

Lastly, shoulder straps 22 and 24 converge to a central point to join the female portion of clasp 26. Clasp 26, like all clasps utilized in the invention, is so constructed that at the point that it is joined by shoulder straps 22 and 24, it has a small pin running transversely which is received into a loop formed of the material of shoulder straps 22 and 24 bent back upon themselves and sewed. Clasp 26 receives the male portion of the same clasp which is attached to under-the-seat strap 34 (FIG. 3).

Figure 3:
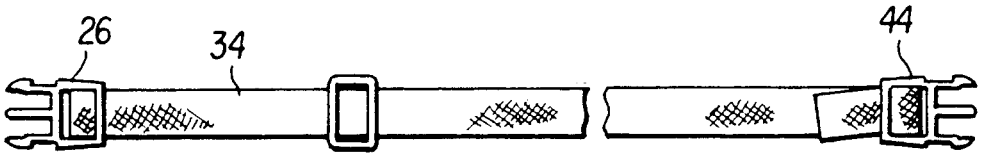
FIG. 3 is a top view of the under-the-seat connecting strap.

Referring now to FIG. 3, a top view is shown of under-the-seat strap 34 broken away but showing male portion of clasp 26 at one end and the male portion of clasp 44 at the other. It is noted that under-the-seat strap 34 is fixedly attached to clasp 26 wherein the end of strap 34 is formed into a tight loop and sewed, the loop passing around the transverse pin of clasp 26. Under-the-seat strap 34 connection with clasp 44 is not secured, but merely passes through an opening of the clasp having the centrally located transverse pin so that the clasp position on strap 34 is adjustable. Strap 34, in the preferred embodiment, is approximately four (4) feet long. It is noted that all of the straps utilized in the invention are made from thin soft nylon belt material of a width of approximately one (1) inch. Panel 12 is constructed from the same thin soft nylon belt material originally of a width of 10 inches. It is folded over widthwise and then the long joining sides sewed together. It was then turned inside out so that the lengthwise seam was hidden. Its width in the invention was approximately $4\frac{3}{4}$ inches.

Figure 4:
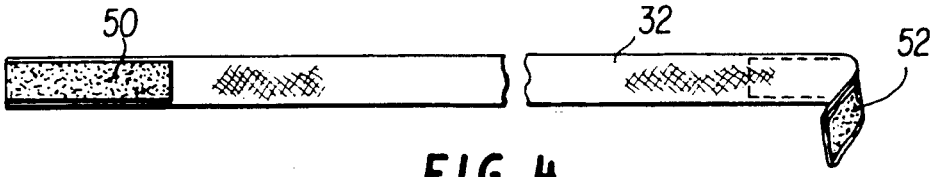
FIG. 4 is a top view of the chest straps.

Next, FIG. 4 shows a top view of chest strap 32 where for brevity, the strap has been broken near each end. At one end of chest strap 32 is VELCRO hook and loop type fastener 50 of the loop-type and at the other end of strap 32 is VELCRO hook and loop type fastener 52 of the hook-type. It is noted that one fastener is on one side of the strap 32 and the other fastener is on the opposite side of the strap. By this means, the ends of the strap may be joined together at the rear portion of panel 12 when the strap encircles the child without rotating the strap. As earlier mentioned, chest strap 32 passes through loops 30 on shoulder straps 22 and 24 and loop 37 on panel 12. Chest strap 32 in the preferred embodiment was approximately 42 inches long.

Figure 5:
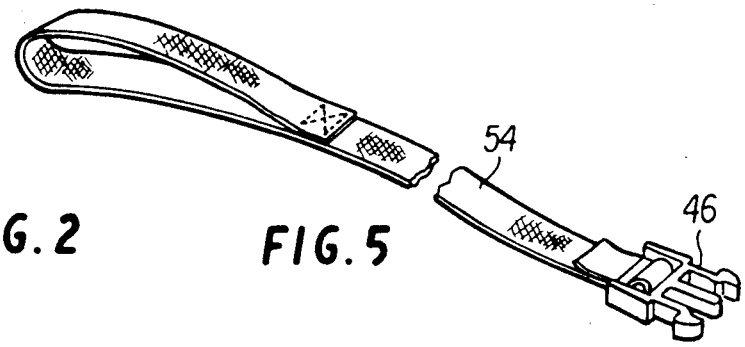
FIG. 5 is a perspective view of the holding and walking strap.

FIG. 5 is a top perspective view of holding and walking strap 54 which has one end the strap material formed into a hand sized loop adaptable to be held in an adult's hand and at the other end the male portion of clasp 46. When the invention is being used to support a child upright while the child learns to walk, both portions of clasp 46 are joined together and the adult holds onto the loop of strap 54 to help the child remain erect while it is learning to walk. In the preferred embodiment, holding and walking strap 54 is approximately a foot and a half long.

Figure 6:
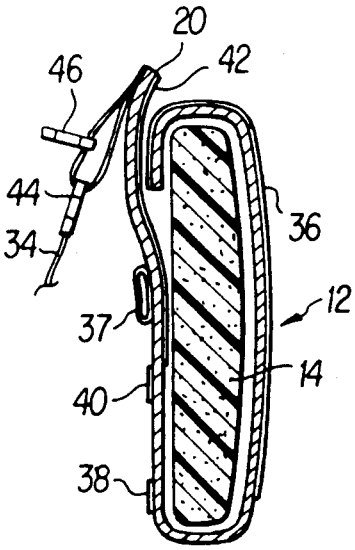
FIGS. 6, 7, and 8 are cross sectional views of the invention fitted to encompass varying sizes of highchair backs.
Figure 7:
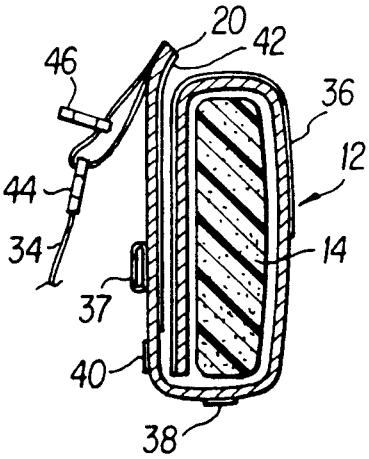
Figure 8:
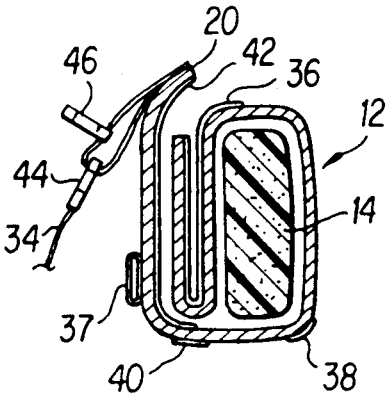

Referring now to FIGS. 6, 7, and 8, a cross sectional view is shown of the subject invention in place upon highchair backs 14, of various heights. In the drawings, panel 12 is separated to better shown the orientation, it being understood that panel 12 wraps tightly upon itself. In FIG. 6, the highchair back is of maximum height presently available, i.e., approximately seventeen (17) inches. Here, panel 12 has been completely wrapped around highchair back 14 and as can be seen, required all of panel 12 to encircle the highchair back 14 with just a small overlap. It is noted that by the method of wrapping shown in FIG. 6, the relatively soft, non-abrasive loop-type VELCRO hook and loop type fastener 36 shown by a dark line is on the outside and it is this side of the highchair which receives the child. Thus, an abrasive hook-type VELCRO hook and loop type fastener will not be engaging the child's skin. VELCRO hook and loop type fastener 42, also shown by a dark line, of the hook-type then comes up behind highchair back 14 to engage loop-type VELCRO hook and loop type fastener 36 in a tightly secured fashion around back 14. The two (2) clasps 44 and 46 are shown, clasp 44 having both male and female portions and clasp 46 having only the female portion. Under-the-seat strap 34 (a portion of which shown) connects to the male half of clasp 44. Leading edge 20 of back panel 12 which protrudes up above the highchair back 14 is also shown. Please note that shoulder straps 22 and 24 have been omitted from FIG. 6 for purposes of clarity. Also shown from the side are VELCRO hook and loop type fasteners 38 and 40. All VELCRO hook and loop type fasteners have been shown by solid line in FIG. 6 as they would appear in a cross sectional side view.

Referring now to FIG. 7, the subject invention is shown wrapped around a medium sized highchair back 14, such as might be found in one having a height of ten (10) to twelve (12) inches. Note that the position of the two (2) clasps 44 and 46 remain relatively the same, i.e., near the top edge of the highchair back 14. The end of panel 12 having VELCRO hook and loop type fastener 36 has now been pulled further into the circle or loop encompassing back 14 to make the resulting circle smaller. This technique has its limits as will be seen in FIG. 8. Again, hook-type VELCRO hook and loop type fastener 42 is set to engage the loop-type VELCRO hook and loop type fastener 36 and only the loop-type VELCRO hook and loop type fastener 36 will touch the child's skin.

FIG. 8 details the subject invention used around a small sized highchair back 14 such as might be found in one having a height of five (5) to eight (8) inches. It is noted here that the end of the panel 12 having VELCRO hook and loop type fastener 36 has been folded upon itself on the side of back 14 opposite the child and that the hook-type VELCRO hook and loop type fastener 42 on the bottom side of panel 12 attaches to loop-type VELCRO hook and loop type fastener 36 at or near the end of VELCRO hook and loop type fastener 36 at the top of highchair back 14.

Thus by the judicious placement of VELCRO hook and loop type fasteners on panel 12, panel 12 may be appropriately folded to encompass all sizes of highchair backs so as not to limit the applicability of the invention.

Figure 9:
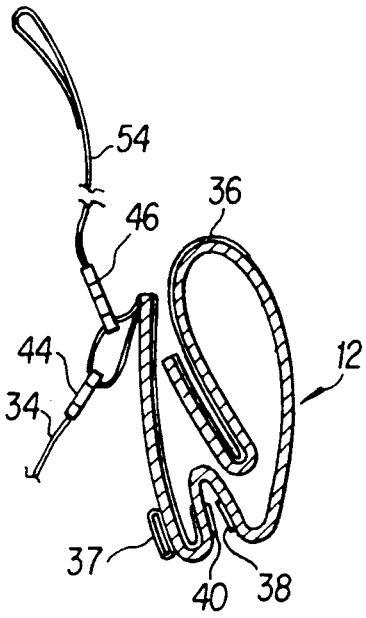
FIG. 9 is a cross sectional view of the invention strategically folded as used attaching to a child when the child is being held erect while learning to walk.

Lastly, FIG. 9 illustrates the use of the invention where it has been folded to its most compact position for use when it resides entirely upon a child's back. In this orientation, chest strap 32 still encircles the child's chest and the under-the-seat strap 34 runs from the child's stomach area through and between the child's legs to come up behind the child and attach to clasp 44. It is noted that with this particular use of the invention, the chest strap may not be necessary or desired and so it is optional. The holding and walking strap 54 then, through its clasp 46, attaches to back panel 12 as shown in FIG. 9. The adult walking the child holds on to strap 54.

Still referring to FIG. 9, it is noted that the hook-type VELCRO hook and loop type fastener 42 attaches to the loop-type VELCRO hook and loop type fastener 36 although most of the panel having fastener 36 attached to it is folded up and surrounded. To take up and render smaller the new package created by the panel 14, the loop-type VELCRO hook and loop type fastener 38 is attached to the hook-type VELCRO hook and loop type fastener 40 to take up more of panel 12, thus rendering the package as small as possible. At all times, the portion of panel 12 presented the child's back is either the soft nylon material or the soft loop-type VELCRO hook and loop type fastener so as not to abraise the child's skin. Attached to the male portion of clasp 46, but reduced considerably in size, is holding and walking strap 54. As was the case in the drawings of FIGS. 6 through 8, the drawing of FIG. 9 does not include the shoulder straps 22 and 24, nor chest strap 32 which will be utilized in securing the child to the chair. A portion of under-the-seat strap 34 is shown connected to the male portion of clasp 44.

Thus with the arrangement of the elements of the invention, a child is safely, firmly but comfortably, held in its highchair. Further, easy and quick placement and removal of the child is afforded since the shoulder straps and the under-the-seat strap is removed by one clasp separation. The chest strap may be lifted off with the shoulder straps or may be removed separately. All clasps are of the easily releasable type.

All straps utilized were sufficiently wide that the child experience no cutting or binding of his skin, and since the shoulder straps are attached to the elongated panel at opposite sides, the elongated panel must be sufficiently side so that it separates the shoulder straps so as not to force the straps uncomfortably against the child's neck. Consequently, the panel width should be at least 4 times the strap width.

It is obvious that the invention is also easily applicable to a child's stroller providing the stroller has a back to it that may be encompassed by the panel of the invention. The under-the-seat strap can either pass under the seat of the stroller if possible or the child may sit upon it.

While a preferred embodiment of the invention has been shown and described, it will be appreciated that other such embodiments of the invention are possible and that there is no intent to limit the invention by such disclosure, but rather that it is intended to cover all modifications and alternate embodiments falling within the spirit and the scope of the invention as defined in the appended claims.

I claim:

1. A restraining harness to secure a child in highchairs having a seat and a horizontal back member of varying vertical heights, the restraining harness comprising:

an elongated panel adapted to be operably attached to the highchairs' back, said elongated panel comprising flexible material and having a length with a first end and a second end, and a front and rear side, said elongated panel further including:

a first plurality of loop type fastener material strips situated on said front side proximate said second end and a second plurality of hook type fastener material strips situated on said rear side proximate said first end;

a third loop type fastener material strip situated on said front side spaced from said first plurality of loop type fastener material and a fourth hook type fastener material strip situated on said front side between said first plurality of loop type fastener material and said third loop type fastening material;

said elongated panel vertically encircling the highchairs' back member to permit said elongated panel first plurality of loop type fastener material to engage said elongated panel second plurality of hook type fastener material at selected points and to selectively permit said third loop type fastener material strip to engage said fourth hook type fastener material strip to form a loop to take up a portion of said elongated panel to selectively vary the length of the elongated panel, said elongated panel vertically encircling the horizontal back member in a secured manner;

a plurality of shoulder straps fixedly attached to said elongated panel, said plurality of shoulder straps adapted to pass over a child's shoulders; and an under-the-seat strap operably attached to said plurality of shoulder straps, said under-the-seat strap adapted to pass under the highchairs' seat and operably attach to said elongated panel whereby a child may be secured in the highchairs.

2. The restraining harness as defined in claim 1 wherein said plurality of shoulder straps comprise a pair of straps, each strap having a first and second end, said first end of each shoulder strap fixedly attached to said first end of said elongated panel in a spaced apart relationship.

3. The restraining harness as defined in claim 2 wherein said elongated panel has a width and each said shoulder straps have a width, said elongated panel width at least 4 times the shoulder straps' width.

4. The restraining harness as defined in claim 3 further including a holding strap operably attached to said pair of shoulder straps at a point spaced away from said elongated panel first end, said holding strap keeping said pair of shoulder straps parallel as they pass over a child's shoulders.

5. The restraining harness as defined in claim 4 wherein each said second ends of said shoulder straps converge from said holding strap to join at a point, at which they are connected to the under-the-seat strap by a separable first clasp having a male and female portion, said female portion is operably attached to said second ends of said shoulder straps at the point where the shoulder straps they join to each other whereby the shoulder straps pass between a child's legs to secure a child.

6. The restraining harness as defined in claim 5 wherein said under-the-seat strap also includes said male portion of said separatable first clasp, said first clasp male portion adapted to engage said shoulder strap first clasp female portion.

7. The restraining harness as defined in claim 6 further including a separatable second clasp having a male and female portion, said under-the-seat strap including said male portion of said separatable second clasp, and said elongated panel includes said female portion of said separatable second clasp, said under-the-seat strap male portion of said second clasp and said elongated panel female portion of said second clasp adapted to mate to secure said second end of said pair of shoulder straps to said panel and enclose a child.

8. The restraining harness as defined in claim 7 further including a chest encircling strap, said chest encircling strap operably attached to said pair of shoulder straps and said panel.

9. The restraining harness as defined in claim 8 further including a pair of strap loops, one each operably attached to each of said shoulder straps at a point interposed said holding strap and said first clasp female portion, and a strap loop operably attached to said panel whereby said chest encircling strap passes through said strap loops attached to said shoulder straps and said strap loop attached to said panel to hold the chest encircling strap to a child chest height.

10. The restraining harness as defined in claim 9 wherein said elongated panel has a length, and said first and second plurality of fastener material strips each have a length, said first plurality of fastener material strips of a length of ½ said elongated panel length and said second plurality of fastener material strips of a length of ¼ said panel length whereby said elongated panel may encompass highchairs' backs of varying heights and still present soft-sided loop-type fastener material to touch the child.

11. A combined walking harness for use in holding a child erect while learning to walk and restraining harness to secure a child in highchairs having seats and backs, in which the backs of the highchairs may have different lengths, the harness comprising:

an elongated panel adapted to be placed upon the child's back, said elongated panel comprising flexible material having a length with a first end and a second end, and a front and rear side, said elongated panel further including:

a first plurality of loop type fastener material strips situated on said front side proximate said second end and a second plurality of hook type fastener material strips situated on said rear side proximate said first end;

a third loop type fastener material strip situated on said front side spaced from said first plurality of loop type fastener material, and a fourth hook type fastener material strip situated on said front side between said first plurality of loop type fastener material and said third loop type fastening material;

said first plurality of loop type fastener material adapted to engage said elongated panel second plurality of hook type fastener material at selected points enabling attachments to the back of the highchair and said third loop type fastener material strip adapted to engage said fourth hook type fastener material strip to form a loop to take up a portion of said elongated panel, said engagement of fastener materials enabling said elongated panel to be tightly compacted to reduce its bulk upon the child's back when it is attached to the back of the highchair;

a plurality of shoulder straps fixedly attached to said elongated panel, said plurality of shoulder straps adapted to pass over a child's shoulders;

an under-the-seat strap operably attached to said plurality of shoulder straps, said under-the-seat strap adapted to pass between the child's legs and operably attached to attach to said elongated panel; and a walking strap operably attached to said panel whereby as the child is secured by said elongated panel, shoulder straps, and under-the-seat strap, the adult may grasp the walking strap to hold the child erect while the child is learning to walk.

12. The walking harness for use in holding a child erect while learning to walk as defined in claim 11 wherein said elongated panel comprises flexible material, has a first end and a second end, and a width, and is adapted to fold back on itself to a compact configuration.

13. The walking harness as defined in claim 12 wherein said plurality of shoulder straps comprise a pair of straps, each of said straps having a first and second end, and a width, said first end of each shoulder strap fixedly attached to said first end of said elongated panel in a spaced apart relationship, and said elongated panel width at least 4 times said shoulder strap's width.

14. The walking harness as defined in claim 13 further including a holding strap operably attached to said pair of shoulder straps at a point spaced away from said elongated panel first end, said holding strap keeping said pair of shoulder straps parallel as they pass over a child's shoulders; and each said second ends of said shoulder straps converge from said holding strap to join at a point, and a separatable first clasp having a male and female portion, said female portion operably attached to said second ends of said shoulder straps at the point they join to each other whereby the shoulder straps pass between a child's legs.

15. The walking harness as defined in claim 14 wherein said under-the-seat strap also includes said male portion of said separatable first clasp, said first clasp male portion adapted to engage said shoulder strap first clasp female portion; and said under-the-seat strap further includes said male portion of said separatable second clasp and said elongated panel includes said female portion of said separatable second clasp, said under-the-seat strap male portion of said second clasp and said elongated panel female portion of said second clasp adapted to mate to secure said second end of said pair of shoulder straps to said panel and enclose a child.

* * * * *